US008674911B2

(12) United States Patent
White

(10) Patent No.: US 8,674,911 B2
(45) **Date of Patent: *Mar. 18, 2014**

(54) ELECTROLUMINESCENT DEVICE AGING COMPENSATION WITH MULTILEVEL DRIVE

(71) Applicant: Global OLED Technology LLC, Herndon, VA (US)

(72) Inventor: Christopher J. White, Avon, NY (US)

(73) Assignee: Global OLED Technology LLC, Herndon, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/875,437

(22) Filed: May 2, 2013

(65) Prior Publication Data

US 2013/0241811 A1 Sep. 19, 2013

Related U.S. Application Data

(63) Continuation of application No. 13/017,749, filed on Jan. 31, 2011, now Pat. No. 8,456,390.

(51) Int. Cl.
*G09G 3/30* (2006.01)
*G09G 3/10* (2006.01)

(52) U.S. Cl.
USPC ..... 345/77; 315/169.3

(58) Field of Classification Search
USPC ..... 345/76, 77, 204, 690, 45, 904; 315/169.3
See application file for complete search history.

(56) References Cited

U.S. PATENT DOCUMENTS

| | | | | |
|---|---|---|---|---|
| 4,769,292 | A | 9/1988 | Tang et al. | |
| 5,061,569 | A | 10/1991 | VanSlyke et al. | |
| 6,414,661 | B1 | 7/2002 | Shen et al. | |
| 6,777,887 | B2 * | 8/2004 | Koyama | 315/169.3 |
| 6,963,321 | B2 | 11/2005 | Everitt | |
| 6,995,519 | B2 | 2/2006 | Arnold et al. | |
| 7,224,332 | B2 | 5/2007 | Cok | |
| 7,355,574 | B1 | 4/2008 | Leon et al. | |
| 7,557,367 | B2 | 7/2009 | Rogers et al. | |
| 7,615,800 | B2 | 11/2009 | Kahen | |
| 7,622,367 | B1 | 11/2009 | Nuzzo et al. | |
| 7,799,699 | B2 | 9/2010 | Nuzzo et al. | |
| 7,928,936 | B2 | 4/2011 | Levey et al. | |
| 7,943,491 | B2 | 5/2011 | Nuzzo et al. | |
| 8,004,479 | B2 * | 8/2011 | White et al. | 345/76 |
| 8,130,182 | B2 | 3/2012 | Levey et al. | |

(Continued)

FOREIGN PATENT DOCUMENTS

| | | |
|---|---|---|
| JP | 2009075319 | 4/2009 |
| WO | WO03/019510 | 3/2003 |

*Primary Examiner* — Thuy Vinh Tran
(74) *Attorney, Agent, or Firm* — Global OLED Technology LLC

(57) ABSTRACT

An electroluminescent (EL) device with aging compensation has a luminance and a chromaticity that both correspond to the density of the current and the age of the EL emitter. Different black, first and second current densities are selected based on the measured age, each corresponding to emitted light colorimetrically distinct from the light emitted at the other two current densities. Respective percentages of a selected emission time are calculated for each current density to produce a designated luminance and chromaticity. The current densities are provided to the EL emitter for the calculated respective percentages of the emission time so that the integrated light output of the EL emitter during the selected emission time is colorimetrically indistinct from the designated luminance and chromaticity, no matter the age of the EL emitter.

20 Claims, 11 Drawing Sheets

(56) References Cited

U.S. PATENT DOCUMENTS

| | | | |
|---|---|---|---|
| 8,159,150 | B2 | 4/2012 | Ashdown et al. |
| 8,279,143 | B2 | 10/2012 | Nathan et al. |
| 8,358,256 | B2 | 1/2013 | Hamer et al. |
| 2002/0167474 | A1 | 11/2002 | Everitt |
| 2007/0290947 | A1 | 12/2007 | Cok |
| 2008/0185971 | A1 | 8/2008 | Kinoshita |
| 2009/0079678 | A1 | 3/2009 | Ozawa |
| 2010/0123268 | A1 | 5/2010 | Menard |

* cited by examiner

ELECTROLUMINESCENT DEVICE AGING COMPENSATION WITH MULTILEVEL DRIVE

CROSS REFERENCE TO RELATED APPLICATION

This application is a continuation of U.S. patent application Ser. No. 13/017,749, filed Jan. 31, 2011 entitled "ELECTROLUMINESCENT DEVICE AGING COMPENSATION WITH MULTILEVEL DRIVE" by Christopher J. White.

Reference is made to commonly-assigned U.S. patent application Ser. No. 12/191,478, issued as U.S. Pat. No. 7,999,454; commonly-assigned U.S. patent application Ser. No. 12/272,222, issued as U.S. Pat. No. 8,358,256; and commonly assigned U.S. application Ser. No. 13/017,657, filed Jan. 31, 2011 entitled "Electroluminescent device multilevel-drive chromaticity-shift compensation" by White et al., the disclosures of which are incorporated by reference herein.

FIELD OF THE INVENTION

The present invention relates to solid-state electroluminescent (EL) flat-panel devices, such as organic light-emitting diode (OLED) displays and lamps, and more particularly to such devices adapted to compensate for the changes in performance with use of the electroluminescent device components.

BACKGROUND OF THE INVENTION

Electroluminescent (EL) devices are used in display devices and solid-state lighting (SSL) lamps. EL displays employ both active-matrix and passive-matrix control schemes and can employ a plurality of subpixels. Each subpixel contains an EL emitter and a drive transistor for driving current through the EL emitter. The subpixels are typically arranged in two-dimensional arrays with a row and a column address for each subpixel, and having a data value associated with the subpixel. Subpixels of different colors, such as red, green, blue, and white, are grouped to form pixels. EL lamps can employ constant- or alternating-current or voltage drive schemes. They can include a single, large area EL emitter operated at a low voltage, a plurality of small area EL emitters arranged in series so that the lamp is operated at a high voltage, and other configurations known in the art. EL devices can be made from various emitter technologies, including coatable-inorganic light-emitting diode, quantum-dot, and organic light-emitting diode (OLED).

EL emitters use current passing through thin films of organic material to produce light. In an OLED emitter, the color of light emitted and the efficiency of the energy conversion from current to light are determined by the composition of the organic thin-film material(s) used and the conditions under which it the device operated, such as the current density through the material. Different organic materials emit different colors of light. However, as the emitter is used, the organic materials in the emitter age and become less efficient at emitting light. This reduces the lifetime of the emitter. Different organic materials layered in a single emitter can age at different rates, causing differential color aging and a device whose white point varies as the device is used. The rate at which the materials age is related to the amount of current that passes through the emitter, which, in turn, is related to the amount of light that has been emitted from the emitter. Various techniques to compensate for this aging effect have been described.

U.S. Pat. No. 6,414,661 B1 by Shen et al. describes a method and associated system to compensate for long-term variations in the light-emitting efficiency of individual organic light-emitting diodes (OLEDs) in an OLED display by calculating and predicting the decay in light output efficiency of each pixel based on the accumulated drive current applied to the pixel. The method derives a correction coefficient that is applied to the next drive current for each pixel. This technique requires the measurement and accumulation of drive current applied to each pixel, requiring a stored memory that must be continuously updated as the display is used, and therefore requiring complex and extensive circuitry.

US Patent Application No. 2002/0167474 A1 by Everitt describes a pulse width modulation driver for an OLED display. One embodiment of a video display includes a voltage driver for providing a selected voltage to drive an organic light-emitting diode in a video display. The voltage driver can receive voltage information from a correction table that accounts for aging, column resistance, row resistance, and other diode characteristics. In an embodiment, the correction tables are calculated prior to or during normal circuit operation. Since the OLED output light level is assumed to be linear with respect to OLED current, the correction scheme is based on sending a known current through the OLED diode for a duration of time sufficiently long to permit the transients to settle out, and then measuring the corresponding voltage with an analog-to-digital converter (A/D) residing on the column driver. A calibration current source and the A/D can be switched to any column through a switching matrix.

U.S. Pat. No. 6,995,519, by Arnold et al., teaches a method of compensating for aging of an OLED emitter. Yet another method for aging compensation is described in US 2010/0156766 by Levey et al. The disclosure of both of these ('519 and '766) is incorporated herein by reference.

US Patent Application Publication No. 2009/0189530 by Ashdown et al. describes feedback control of RGB LEDs by superimposing AM modulation on the PWM drive signal. However, the AM modulation does not provide control of chromaticity or luminance. It serves only to differentiate the R, G and B channels when sensed by a single photosensor. It is not applicable to single-color systems such as an EL lamp with only white broadband EL emitters.

US Patent Application Publication No. 2008/0185971 by Kinoshita describes adjusting current density and duty cycle of an EL emitter independently to vary chromaticity while keeping luminance constant. However, this scheme does not perform any compensation, for aging or otherwise.

US 2009/0079678 describes a technique for reducing power consumption of an OLED by reducing drive signal, and therefore panel luminance, if an image is displayed that does not contain information in the shadow region of the tonescale.

SUMMARY OF THE INVENTION

EL materials can produce light of a different spectrum, and therefore a different chromaticity, at different current densities. As an EL emitter ages, the relationship between current density and chromaticity for that emitter can change. Some of the above schemes require, or implicitly assume, that the chromaticity of the OLED emitter is constant even when current density changes. This is not the case for many modern emitters, particularly broadband (e.g., yellow or white) emitters. The scheme of Kinoshita '971 is limited to only the chromaticities the EL emitter can produce natively. This is not sufficient for full-color display, or for adjustable-chromaticity lamps in which the desired chromaticity may not lie on the chromaticity locus of the EL emitter. There is a need, therefore, for a more complete compensation approach for aging of electroluminescent emitters and chromaticity shift of those emitters with current density as the emitters age.

According to an aspect of the present invention, therefore, there is provided an electroluminescent (EL) device with compensation for aging, comprising:

a) an EL emitter adapted to receive current and emit light having a luminance and a chromaticity that both correspond to the density of the current and an age of the EL emitter;

b) a drive circuit electrically connected to the EL emitter for providing the current to the EL emitter;

c) means for measuring the age of the EL emitter;

d) means for selecting different black, first and second current densities based on the measured age, wherein i) at the selected black, first and second current densities the emitted light has respective black, first and second luminances and respective black, first and second chromaticities;

ii) the respective luminance of each of the black, first and second current densities is colorimetrically distinct from the other two luminances, or the respective chromaticity of each of the black, first and second current densities is colorimetrically distinct from the other two chromaticities; and iii) the black luminance is less than a selected threshold of visibility, and the first and second luminances are greater than or equal to the selected threshold of visibility;

e) means to receive a designated luminance and a designated chromaticity for the EL emitter;

f) means for calculating respective black, first and second percentages of a selected emission time using the designated luminance, the designated chromaticity, and the black, first and second luminances and chromaticities, wherein the sum of the black, first and second percentages is less than or equal to 100%; and g) means for providing the black, first and second percentages to the drive circuit to cause it to provide the black, first and second current densities to the EL emitter for the black, first and second percentages, respectively, of the selected emission time, so that the integrated light output of the EL emitter during the selected emission time has an output luminance and output chromaticity colorimetrically indistinct from the designated luminance and designated chromaticity, respectively, whereby the aging of the EL emitter is compensated.

According to another aspect of the present invention, there is provided an electroluminescent (EL) device with compensation for aging, comprising:

a) an EL emitter adapted to receive current and emit light having a luminance and a chromaticity that both correspond to the density of the current and an age of the EL emitter;

b) a drive circuit electrically connected to the EL emitter for providing the current to the EL emitter;

c) means for measuring the age of the EL emitter;

d) means for selecting different black, first, second and third current densities based on the measured age, wherein i) at the selected black, first, second and third current densities the emitted light has respective black, first, second and third luminances and respective black, first, second and third chromaticities;

ii) the respective luminance of each of the black, first, second and third current densities is colorimetrically distinct from the other three luminances, or the respective chromaticity of each of the black, first, second and third current densities is colorimetrically distinct from the other three chromaticities; and iii) the black luminance is less than a selected threshold of visibility, and the first, second and third luminances are greater than or equal to the selected threshold of visibility;

e) means for receiving a designated luminance and a designated chromaticity for the EL emitter;

f) means for calculating respective black, first, second and third percentages of a selected emission time using the designated luminance, the designated chromaticity, and the black, first, second and third luminances and chromaticities, wherein the sum of the black, first, second and third percentages is less than or equal to 100%; and g) providing the black, first, second and third percentages to the drive circuit to cause it to provide the black, first, second and third current densities to the EL emitter for the black, first, second and third percentages, respectively, of the selected emission time, so that the integrated light output of the EL emitter during the selected emission time has an output luminance and output chromaticity colorimetrically indistinct from the designated luminance and designated chromaticity, respectively, whereby the aging of the EL emitter is compensated.

According to another aspect of the present invention, there is an electroluminescent (EL) device with compensation for aging of, comprising:

a) a device substrate having a device side;

b) an EL emitter adapted to receive current and emit light having a luminance and a chromaticity that both correspond to the density of the current and an age of the EL emitter, wherein the EL emitter is disposed over the device side of the device substrate;

c) an integrated circuit chiplet having a chiplet substrate different from and independent of the device substrate, wherein the chiplet includes a drive circuit electrically connected to the EL emitter for providing the current to the EL emitter and the chiplet is located over, and affixed to, the device side of the device substrate;

d) means for measuring the age of the EL emitter;

e) means for selecting different black, first and second current densities based on the measured age, wherein i) at the selected black, first and second current densities the emitted light has respective black, first and second luminances and respective black, first and second chromaticities;

ii) the respective luminance of each of the black, first and second current densities is colorimetrically distinct from the other two luminances, or the respective chromaticity of each of the black, first and second current densities is colorimetrically distinct from the other two chromaticities; and iii) the black luminance is less than a selected threshold of visibility, and the first and second luminances are greater than or equal to the selected threshold of visibility;

f) means to receive a designated luminance and a designated chromaticity for the EL emitter;

g) means for calculating respective black, first and second percentages of a selected emission time using the designated luminance, the designated chromaticity, and the black, first and second luminances and chromaticities, wherein the sum of the black, first and second percentages is less than or equal to 100%; and h) means for providing the black, first and second percentages to the drive circuit to cause it to provide the black, first and second current densities to the EL emitter for the black, first and second percentages, respectively, of the selected emission time, so that the integrated light output of the EL emitter during the selected emission time has an output luminance and output chromaticity colorimetrically indistinct from the designated luminance and designated chromaticity, respectively, whereby the aging of the EL emitter is compensated.

An advantage of this invention is an EL device that compensates for the aging of the organic materials in the device without requiring extensive or complex circuitry for accumulating a continuous measurement of light-emitting element use or time of operation. A further advantage is that it can provide aging compensation for EL devices that have only a single color of EL emitter. It is an important feature that it makes positive use of changes in chromaticity with current density which has hitherto been considered undesirable. It advantageously permits the reproduction of colors that lie off the chromaticity locus of a particular EL emitter.

It is a further advantage that it can use simple voltage measurement circuitry. It is a further advantage of various embodiments that by making all measurements of voltage, those embodiments are more sensitive to changes than methods that measure current. It is a further advantage of some embodiments that a single select line can be used to enable data input and data readout. It is a further advantage of some embodiments that characterization and compensation of EL aging are unique to the specific element and are not impacted by other elements that are open-circuited or short-circuited.

DETAILED DESCRIPTION OF THE INVENTION

Figure 1A:
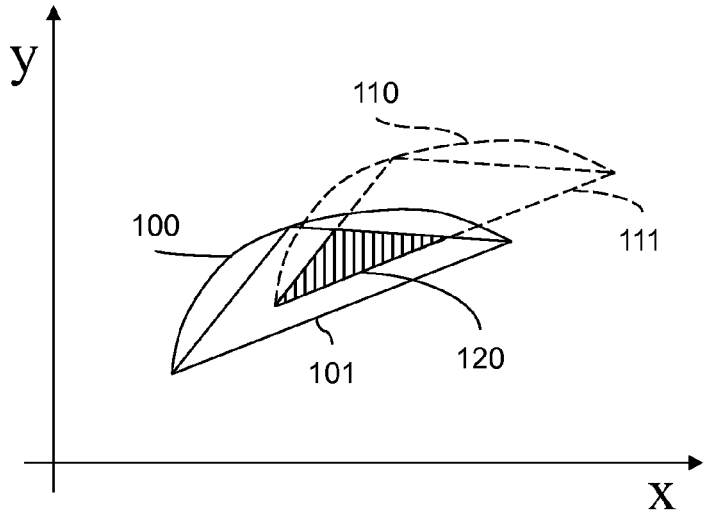
FIG. 1A is an exemplary chromaticity diagram showing characteristics of an EL emitter before and after aging.

FIG. 1A shows an exemplary CIE 1931 x-y chromaticity diagram showing characteristics of an EL emitter 50 (FIG. 8) before and after aging. EL emitter 50 can be embodied in an EL device such as an EL display 10 or EL lamp. The EL emitter 50 receives current and emits light having a luminance (denoted Y) and chromaticity (x, y) that both correspond to the density of the current (J) and the age of the EL emitter 50. Curve 100 shows the chromaticities of EL emitter 50 as current density changes at a first aging level, for example new, or T100 (100% of reference efficiency). Aged curve 110 shows the chromaticities of EL emitter 50 as current density changes at a second aging level, for example end-of-life, or T50 (50% of reference efficiency). In this example, the EL emitter 50 has become more yellow over time (x and y have both increased). EL emitter 50 is preferably a broadband emitter such as a yellow or white emitter.

Three different current densities on each curve can be used to form a gamut analogous to a typical RGB color gamut. Gamut 101 uses three current densities from curve 100, and aged gamut 111 uses three current densities from curve 110. The common overlap of those two gamuts is overlap gamut 121. Any chromaticity within overlap gamut 121 can be reproduced (at some luminance) by EL emitter 50 either before aging (gamut 101) or after aging (aged gamut 111).

Figure 1B:
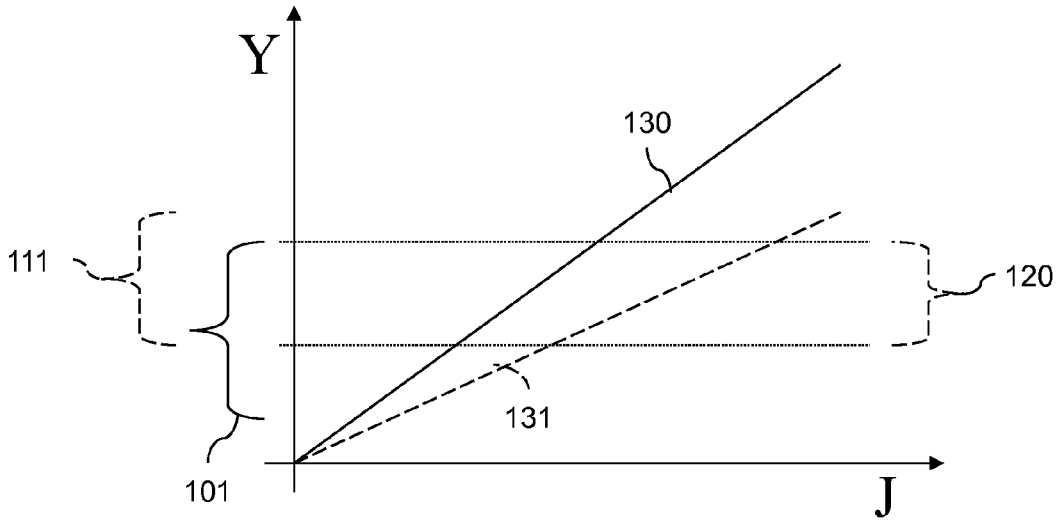
FIG. 1B is an exemplary luminance plot showing characteristics of an EL emitter before and after aging.

FIG. 1B is an exemplary plot showing the luminance of an EL emitter 50 as a function of current density before and after aging. Curve 130 shows the luminance before aging and aged curve 131 shows the luminance after aging. The gamuts 101 and 111 can be unlike conventional RGB gamuts in that the luminances of the three primaries can be very different from each other. In such a situation, the luminances that can be reproduced in the common gamut are those in which gamut 101 and gamut 111 overlap. On the ordinate is shown the luminance range of gamut 101 and the luminance range of gamut 111. The luminance range of a gamut is the range between luminance of the highest and lowest colors reproducible in that gamut, not including the black level (which is always reproducible in any gamut by setting all three primaries to produce as little light as possible, preferably totaling ≤0.1 nits, or more preferably ≤0.05 nits). The luminance range of overlap gamut 121 is shown as the overlap between the luminance ranges of gamut 101 and gamut 111. Colors within the overlap gamut 121 in both luminance and chromaticity can be reproduced either before or after aging. The more luminance and chromaticity variation EL emitter 50 undergoes as current density changes at a given age, the larger overlap gamut 121 can be.

Figure 2A:
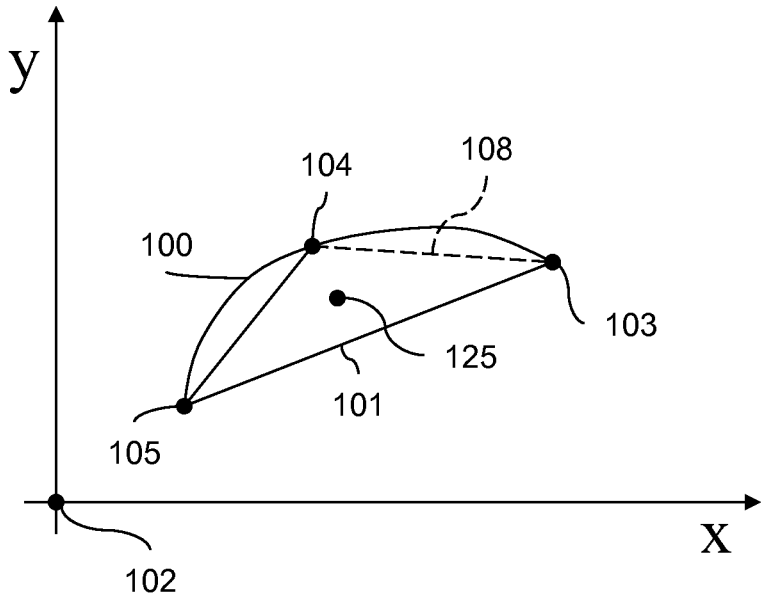
FIG. 2A is an exemplary chromaticity diagram showing primaries of a single EL emitter.
Figure 2B:
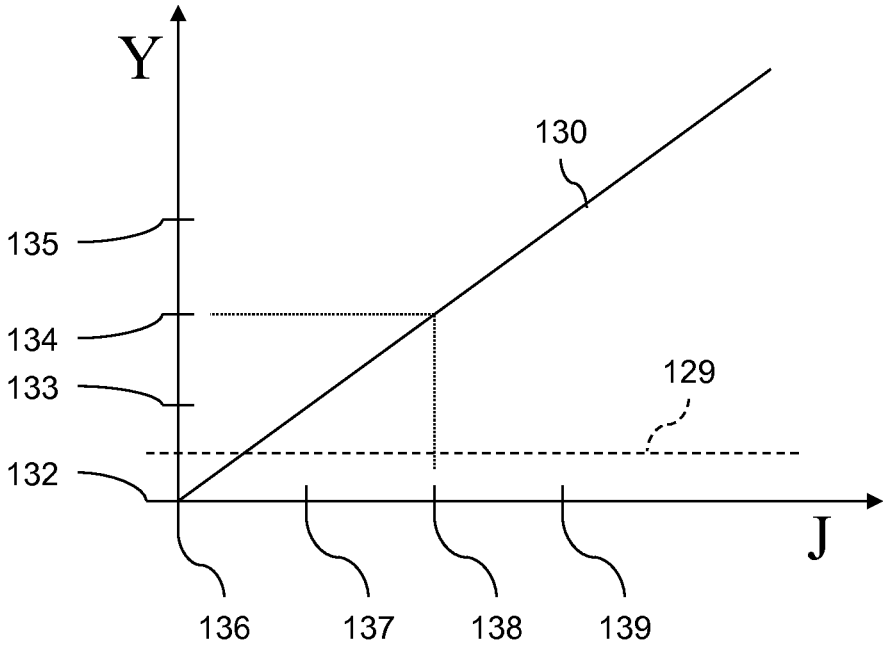
FIG. 2B is an exemplary luminance plot showing primaries of a single EL emitter.

FIG. 2A is a chromaticity (x, y) diagram, and FIG. 2B a current-density-to-luminance plot, showing specific points on curves 100 and 130 which form the primaries of gamut 101. The direction of increasing luminance on curves 100, 130 is shown by the arrows thereon. Points are shown for selected black 136, first 137, second 138 and third 139 current densities. The current densities are selected based on a measured age of EL emitter 50, as will be described further below. When EL emitter 50 is driven with a current having black current density 136, the emitted light has chromaticities at black chromaticity 102 and black luminance 132. Note that "chromaticity" refers here to the chromaticity coordinates x and y considered together. At first current density 137, the emitted light is at first chromaticity 103 and first luminance 133. At second current density 138, the emitted light is at second chromaticity 104 and second luminance 134. At third current density 139, the emitted light is at third chromaticity 105 and third luminance 135. In this example, the black point is shown at Y=0 and (x,y)=(0,0), but that is not required. In some display systems, the black level has a luminance greater than 0, e.g., 0.05 nits, and therefore also non-zero chromaticities.

In some embodiments, only the black, first and second current densities are used. For example, line 108 shows the points in chromaticity space producible using first current density 137 and second current density 138. That line plus black chromaticity 102 (black current density 136) define a gamut (indicated by the dotted lines to black chromaticity 102), albeit a narrow and limited-luminance one, producible using three current densities. In other embodiments, the black, first, second and third current densities are used and the entirety of gamut 101 is producible.

Hereinafter the term "primary" refers to the luminance (e.g., 132) and chromaticity (e.g., 102) produced at a particular current density (e.g., 136). For example, the "first primary" refers to the first luminance 133 and first chromaticity 103 produced by the EL emitter 50 when driven with current at first current density 137. The black point of the display at black current density 136 is referred to as the "black primary." This corresponds to the conventional meaning of "primary" in the art, but expands the definition to permit using multiple current densities of the same EL emitter 50 as different primaries, rather than only using different EL emitters as different primaries. Expressions such as "the luminances of the primaries" refer to the respective luminances of the black, first, second and, in some embodiments, third primaries, i.e. the respective luminances produced by EL emitter 50 at the black, first, second and optionally third current densities.

Each primary is different from the other primaries in either its luminance or chromaticity. That is, no two primaries produce exactly the same luminance and chromaticity. This provides a color gamut. Some primaries can have the same chromaticities but different luminances, some can have the same luminances but different chromaticities, and some can have different luminances and chromaticities. Specifically, the respective luminance (132, 133, 134, 135) of each of the black 136, first 137, second 138 and third 139 current densities is colorimetrically distinct from the other luminances, or the respective chromaticity (102, 103, 104, 105) of each of the black 136, first 137, second 138 and third 139 current densities is colorimetrically distinct from the other chromaticities. In embodiments with only the black, first and second current densities, each of the three chromaticities is colorimetrically distinct from the other two or each of the three luminances is distinct from the other two. In embodiments with the black, first, second and third current densities, each of the four chromaticities is colorimetrically distinct from the other three, or each of the four luminances is colorimetrically distinct from the other three.

"Different" and "colorimetrically-distinct" primaries are those separated visually, e.g., those that are at least 1 just-noticeable-difference (JND) apart. For example, the primaries can be plotted on the 1976 CIELAB L* scale, and any two primaries separated by at least 1 $\Delta E^*$ are colorimetrically-distinct. Distinct chromaticities can also be measured on the CIE 1976 u'v' diagram as those points with $\Delta(u', v') \geq 0.004478$ (the MacAdam J N D, cited on pg. 1512 of Raymond L. Lee, "Mie Theory, Airy Theory, and the Natural Rainbow," Appl. Opt. 37(9), 1506-1519 (1998), the disclosure of which is incorporated by reference herein), where $\Delta(u', v')$ is the Euclidian distance between two points on the CIE 1976 u'v' diagram. Other methods of determining whether two colors or primaries are colorimetrically distinct are well-known in the color science art.

The black luminance 132 is less than a selected threshold of visibility 129, and the first 133, second 134 and third 135 luminances are greater than or equal to the selected threshold of visibility 129. The threshold of visibility 129 is selected based on the limits of the human visual system. For example, the threshold of visibility 129 can be 0.06 nits or 0.5 nits. The threshold of visibility 129 can be selected based on display peak luminance, display dynamic range, and display characteristics (e.g., ambient contrast ratio and surface treatment). The black luminance 132 is less than the threshold of visibility 129 so that the mathematical treatment of gamuts described herein corresponds to the mathematical treatment of conventional RGB gamuts. When using a standard primary matrix or phosphor matrix ("pmat"), intensities of 0 add no luminance or chromaticity to what the user perceives. In various embodiments, intensities of 0 can correspond to black current density 136. Since black luminance 132 is less than threshold of visibility 129, black luminance 132 and black chromaticity 102 add no perceptible brightness or color to what the user perceives, so intensities of 0 behave as expected. To provide a black luminance 132 below threshold of visibility 129, black current density 136 can be less than a selected threshold current density (not shown), e.g., 0.02 $mA/cm^2$.

To produce a color using gamut 101, a designated luminance and a designated chromaticity for the EL emitter 50 are received. An emission time 308 (FIG. 3A), e.g., a frame time such as 16⅔ ms (1/60 s), is selected. Respective black, first, second and, in some embodiments, third percentages of the selected emission time 308 are calculated using the designated luminance, the designated chromaticity, and the black, first, second and optionally third luminances and chromaticities. The sum of the black, first, second and optionally third percentages is less than or equal to 100%. The calculated percentages are the intensities [0,1] of the respective primaries. The intensities sum to ≤1 (the percentages to ≤100%) because only one EL emitter 50 is being used, and therefore time-division multiplexing is used. In some embodiments with only the black, first and second primaries, the black, first and second percentages can sum to 100%. In some embodiments also using the third primary, the black, first, second and third percentages can sum to 100%.

The black, first, second and optionally third percentages are provided to the drive circuit 700 (FIGS. 6, 8, 11) to cause it to provide the black, first, second and optionally third current densities to the EL emitter 50 for the black, first, second and optionally third percentages, respectively, of the selected emission time 308, so that the integrated light output of the EL emitter 50 during the selected emission time 308 has an output luminance and output chromaticity colorimetrically indistinct, i.e. <1 JND, from the designated luminance and designated chromaticity, respectively. As described above, in some embodiments, only the black, first and second current densities, and no others, are provided by the drive circuit 700. In other embodiments, only the black, first, second and third current densities, and no others, are provided by the drive circuit 700.

Once the black 136, first 137, second 138 and optionally third 139 current densities of the primaries are selected based on the measured age of EL emitter 50 (described below), the corresponding luminances and chromaticities of the primaries are used to calculate the percentages of the primaries to be used to produce the designated luminance and chromaticity. In embodiments which do not use the third current density 139, a virtual third primary is used to make a three-primary system. The virtual third primary can be selected having chromaticities which do not lay on the line between the first chromaticity 103 and second chromaticity 104, extended to infinity in both directions. The luminance of the virtual third primary can be selected arbitrarily. For example, the chromaticity of point 125 and the third luminance 135 can be selected as the virtual third primary.

A primary matrix ("pmat") is formed using the first, second and third luminances and chromaticities. The primaries' luminances and chromaticities are transformed into the primaries' XYZ tristimulus values (e.g., using the inverse of CIE 15:2004, 3rd. ed., ISBN 3-901-906-33-9, pg. 15, Eq. 7.3) as in Eq. 1:

$$X_p=x_pY_p/y_p;Z_p=(1-x_p-y_p)Y_p/y_p \quad \text{(Eq. 1)}$$

where p=1, 2 or 3 for the first, second or third primary respectively. If the third current density 139 is not being used, the virtual third primary is employed for $x_3$, $y_3$, $Y_3$. The XYZ tristimulus values of the three primaries are then formed into a pmat according to Eq. 2:

$$pmat = \begin{bmatrix} X_1 & X_2 & X_3 \\ Y_1 & Y_2 & Y_2 \\ Z_1 & Z_2 & Z_3 \end{bmatrix} \quad \text{(Eq. 2)}$$

Unlike conventional RGB-gamut systems, this pmat has no white point and no normalization. The tristimulus values produced by intensities of (1,0,0), (0,1,0), or (0,0,1) are simply those corresponding to the primaries' luminances and chromaticities, not to scaled versions of the luminances. Conventional pmats are described by W. T. Hartmann and T. E. Madden in "Prediction of display colorimetry from digital video signals", J. Imaging Tech, 13, 103-108, 1987, the disclosures of which are incorporated by reference herein.

Designated tristimulus values are then calculated from the designated luminance and chromaticity using Eq. 1, above, to produce $X_d$, $Y_d$, $Z_d$. Intensities for the three primaries are then calculated using Eq. 3:

$$\begin{bmatrix} I_1 \\ I_2 \\ I_3 \end{bmatrix} = pmat^{-1} \times \begin{bmatrix} X_d \\ Y_d \\ Z_d \end{bmatrix} \quad \text{(Eq. 3)}$$

As in conventional systems, any intensity $I_p$ outside of the range [0, 1] is not reproducible. In embodiments without the third current density 139, any substantially non-zero value of $I_3$ (e.g., outside of [−0.01, 0.01]) indicates a non-reproducible color, since the virtual third primary is being used.

$I_1$, $I_2$ and $I_3$ are, respectively, the first, second and third percentages which are provided to the drive circuit 700. The EL emitter 50 is driven to emit light at the first, second and optionally third current density for the percentage of the emission time $t_f$ 308 specified by the respective $I_p$. $\Sigma I_p$ does not have to be 1 (100%); if it is less than 1, the black current density can be provided for the remainder $t_r$ of the emission time 308, or a time less than $t_r$, with $t_r$ being calculated according to Eq. 4:

$$t_r=t_f-\Sigma I_p. \quad \text{(Eq. 4)}$$

In this way, a designated color is produced using the black 136, first 137, second 138 and optionally third 139 current densities selected based on the measured age of EL emitter 50. Consequently, the designated color can be produced at various aging levels of EL emitter 50 using different selected primaries. This permits compensation for the aging of the EL emitter 50. The primaries can be selected using a lookup table which maps the measured age of EL emitter 50 to the selected black 136, first 137, second 138 and optionally third 139 current densities.

Figure 3A:
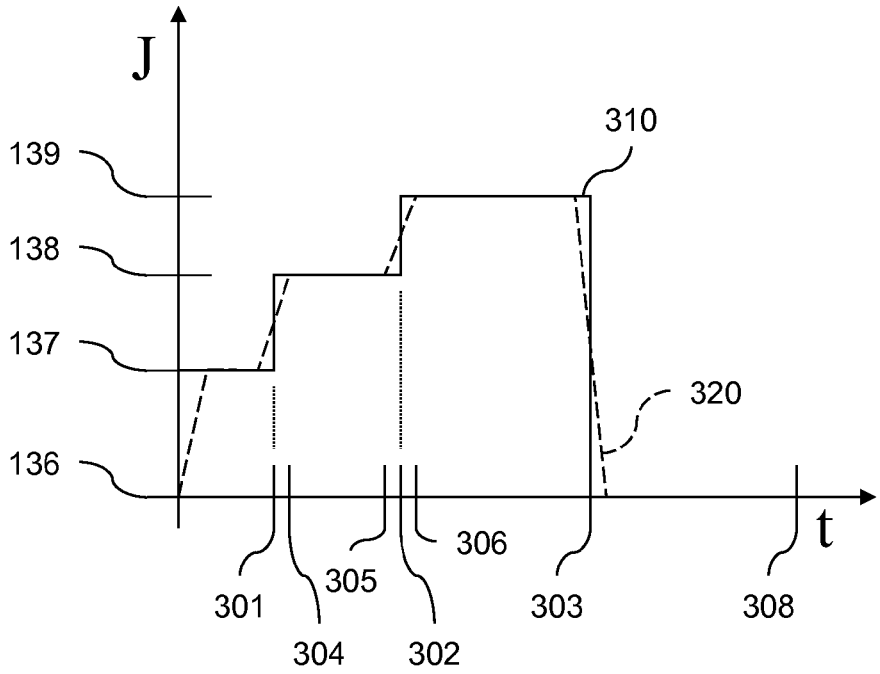
FIG. 3A is a plot of drive waveforms according to various embodiments.

Referring to FIG. 3A, various drive waveforms can be used to provide the primaries' current densities to EL emitter 50 for the corresponding percentages of the emission time 308. The abscissa shows time for a given emission period, [0, $t_f$]; the ordinate shows current density, e.g., in mA/cm$^2$.

Solid-line waveform 310 is a drive waveform using three primaries plus black. At the beginning of the emission time 308, the first current density 137 is provided. At time 301, the second current density 138 is provided. At time 302, the third current density 139 is provided. At time 303, the black current density 136 is provided. Here $\Sigma I_p<1$, and specifically $\Sigma I_p$ equals time 303 (when time 303 is expressed as a percentage of emission time 308).

Dashed-line waveform 320 is a drive waveform like waveform 310, except with ramps between current densities. The $I_p$ values for waveform 320 are the times that the current density being provided to the EL emitter 50 is substantially steady (e.g., within ±5%) of the corresponding selected current density. For example, $I_2$ on waveform 320 is equal to time 305 minus time 304. $I_2$ for waveform 310, however, is equal to time 302 minus time 301. Here the black current density 136 is provided for a time less than $t_r$ of Eq. 4, because some of the emission time is occupied by ramps, e.g., from time 305 to time 306. Specifically, the sum of the black, first and second percentages is less than 100%, and the drive circuit 700 provides current ramps between consecutive current densities to the EL emitter 50. The ramps can be linear, quadratic, logarithmic, exponential, sinusoidal, or other shapes. The actual currents of the ramps can vary ±10% from ideal values. Sinusoidal ramps are sections of a sinusoid, e.g., sin(θ) for θ on [−π/2, π/2] scaled to fit between the current density levels. For example, the current density J(t) of a sinusoidal ramp from second current density 138 ($J_2$) to third current density 139 ($J_3$) from time 305 ($t_{305}$) to time 306 ($t_{306}$) centered on time 302 ($t_{302}$) can be calculated using Eq. 5:

$$J(t) = \frac{(J_3 - J_2)}{2}\sin\left(\frac{\pi}{t_{306} - t_{305}}(t - t_{302})\right) + \frac{(J_3 - J_2)}{2} \quad \text{(Eq. 5)}$$

Ramps, especially sinusoidal ramps, provide smoother transitions between current densities, reducing inductive kick as the current density changes. In an embodiment, no direct control of the ramp is provided. In between one current density and another, there is a transition period including an exponential ramp as capacitive loads charge under a constant applied voltage. In another embodiment, the transition period includes a linear ramp as capacitive loads charge under a constant applied current.

Figure 3B:
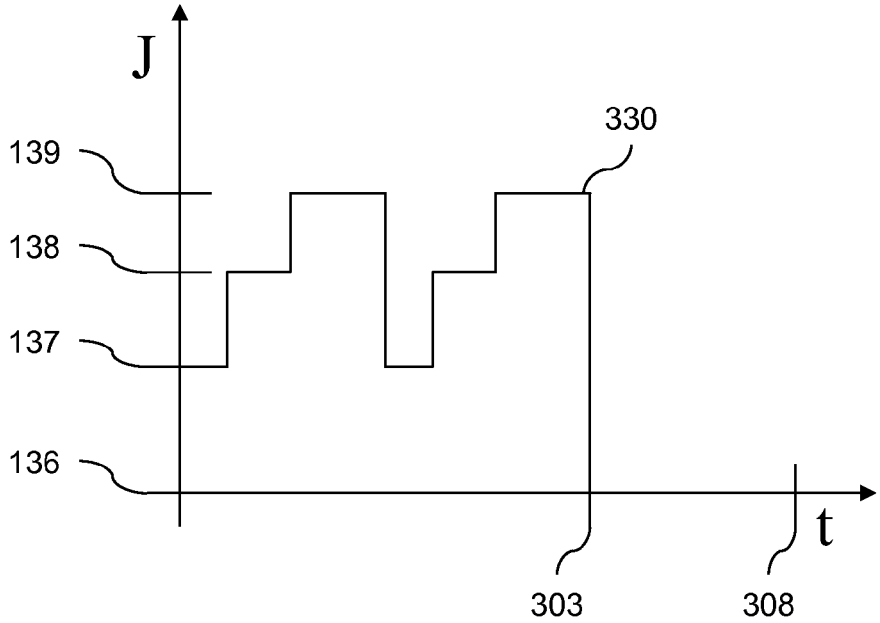
FIG. 3B is a plot of drive waveforms according to various embodiments.

FIG. 3B shows an alternative waveform 330. Waveforms 310 and 320 provide each of the black 136, first 137, second 138 and third 139 current densities for respective uninterrupted periods of time (or black, first and second current densities in embodiments where the third current density 139 is not used). Waveform 330, however, divides each current density's time period $I_p$ into multiple segments, e.g., into two segments. The total times $I_p$ are the same as waveform 310 (and their sum is still time 303), but each is divided in half, and the halves are separated in time. This can reduce the occurrence of dynamic false contouring as a viewer's eye moves over a display, and can reduce flicker. In this case, each of the black, first, second and optionally third current densities are provided for multiple respective separate segments of time in the emission time 308.

The different black, first, second and optionally third current densities are selected based on the measured age. One way to do this is to characterize an EL emitter 50 before mass-production. Based on measurements of the luminance and chromaticity of the W emitter at various ages and current densities, appropriate primaries can be selected for each age. However, given limitations typically placed on the resolution (i.e. driver bit depths) of current densities and intensities, it is not always possible to reproduce identical luminance and chromaticity for given color (e.g., point 125 of FIG. 2A) at two different ages of EL emitter 50. As described above, it is sufficient that the integrated light output of the EL emitter 50 during the selected emission time 308 have an output luminance and output chromaticity colorimetrically indistinct from, although not identical to, the designated luminance and designated chromaticity, respectively. In an example, point 125 requires $I_p$=[0.5, 0.4, 0.75]. In a two-bit system, 0.4 is not an available intensity; only 0, 0.25, 0.5, 0.75 and 1.0 are available. However, if the difference between the tristimulus values corresponding to $I_p$=[0.5, 0.4, 0.75] and to $I_p'$=[0.5, 0.5, 0.75] (0.4 forced to the reproducible intensity 0.5) is less than one JND, the reproduction $I_p'$ is colorimetrically indistinct from the desired reproduction $I_p$, and so is acceptable to a user of the EL device. The bit depths of intensities and current densities should be considered along with the luminances and chromaticities of the EL emitter 50 at various current densities and ages to select the appropriate primaries for each age. Furthermore, different primaries can be selected based not only on the measured age, but also on the designated luminance and chromaticity. This can provide increased gamut but requires more computation or storage. For example, a 2-D lookup table can be used instead of a 1-D lookup table.

In other aspects, the different first 137, second 138 and third 139 current densities can be selected by a computer program based on the measured age of EL emitter 50. The luminances and chromaticities of EL emitter 50 can then be used to produce a primary matrix (pmat) for driving EL emitter 50 to produce a desired color, as described above. The discussion below is for the case of different first 137, second 138 and third 139 current densities, with black 136 current density assumed to be zero, black luminance zero, and black chromaticities therefore irrelevant. The same steps can be used with suitable modifications when black luminance is nonzero, or when third current density 139 is not used.

The program takes as input the luminances (Ys) and chromaticities (xs, ys) of any number of points measured along a current density sweep of EL emitter 50 at any number of ages. It exhaustively tests all possible combinations of three (or four, if including third 139 current density) current densities for each ages to select pmats giving the highest luminance-range overlap between the different ages. The highest overlap will generally result in the widest usable gamut across ages.

The number of current densities input to the program is determined by the resolution with which current densities can be supplied to EL emitter 50. For example, a two-bit current supply can produce four current densities. The number of ages is determined by the resolution with which the age can be measured, and by the time and money available to characterize ages before production. The program also takes a set of RGB intensities (Ints) at which to test each pmat. The number of rows of Ints is determined by the resolution of intensities, i.e. how finely the emission time 308 can be subdivided. Ints preferably includes intensities covering the gamut of the display, or intensities representative of typical colors included on the display.

The program makes all possible pmats for all possible ages. That is, for each set of d current densities measured at a given age, $$\binom{d}{3}$$

pmats are produced (for each, three of the d possible current densities are selected to be first 137, second 138 and third 139 current densities). The program then makes a list of all the possible combinations of those pmats for different ages. In each combination, for each age, any of the $$\binom{d}{3}$$

pmats for that age can be used. For example, suppose there are five current densities and three ages. For each age, there are $$\binom{5}{3} = 10$$

possible pmats. Denote the ages A, B, C; then the pmats for age A are $p_{A,1}$–$p_{A,10}$, and likewise $p_{B,1}$–$p_{B,10}$ for age B and $p_{C,1}$–$p_{C,10}$ for age C. Then the first combination is $p_{A,1}$ with $p_{B,1}$ and $p_{C,1}$. The second combination is $p_{A,1}$, $p_{B,1}$, $p_{C,2}$, and so forth until the last combination, $p_{A,10}$, $p_{B,10}$, $p_{C,10}$. Therefore there are $10^3$=1,000 pmats for this example, or in general $$\binom{d}{3}^a$$

pmats for d current densities measured for each age, and a ages characterized. Recall that each $p_{a,n}$ is a 3×3 (3 rows, 3 columns) matrix, calculated using the tristimulus values for three current densities, as described above.

The program then calculates, for each combination, the tristimulus and chromaticity of the provided Ints at each age using the pmat included in that combination for that age. Continuing the example above, if Ints is an n×3 matrix, for combination $p_{A,1}$, $p_{B,1}$, $p_{C,1}$, each tristimulus value array $Tri_a$, a∈{A, B, C}, is calculated as $$Tri_a=(p_{a,1}\times Ints^T)^T$$

and is itself n×3. CIE u'v' coordinates $uv_a$ (n×2) are then calculated from the tristimulus values.

Each pair (u', v') in one of the $uv_a$ matrices is a chromaticity coordinate pair that can be reproduced by EL emitter 50, aged to age a, at some luminance. According to various embodiments, first 137, second 138 and third 139 current densities are selected so that, for computed first, second and third percentages $I_1$, $I_2$ and $I_3$, respectively, the integrated light output of EL emitter 50 during the selected emission time will have an output chromaticity colorimetrically indistinct from the designated chromaticity. The program therefore divides the space $uv_a$ of reproducible chromaticities into groups of chromaticities that are colorimetrically indistinct from each other. The program locates indices g, k of a pmat $p_{g,k}$ that can produce the designated chromaticity at a desired range of luminances.

To do so, the program calculates a rectangular range in u'v' space spanning the mean±1 std. dev. of all the u' and all the v' values of all $uv_a$ for the combination being considered. This is to find a rough range for the u'v' values that can be reproduced at all the characterized ages for the particular combination of pmats in question. That is, $uv_a$ values are likely to fall in the calculated range. The program then spans the range with a grid of 10×10 evenly-spaced points (total 100 points). Around each point, the program draws an area 1 JND in size, e.g., a circle of radius 0.004478/2 (radius 0.004478/2 rather than 0.004478, so that any two points in the circle will be no more than 1 JND apart). The program then determines which points in each $uv_a$ are within each area, i.e., are within 1 JND of each grid point. Any points within a given area are chromatically indistinct from each other. The program then counts the number of points in each area from each age. This computation can also be performed, with suitable modifications, in CIELAB space. Each 1 JND area can then be a sphere of radius 0.5.

It is preferred, although not required, that the chromaticity range to be used be selected so that as wide a luminance range as possible is available as EL emitter 50 ages. Not all of the areas computed above necessarily contain points from all ages, so the program can select an area with the most luminance overlap that contains some points of all ages as a desired chromaticity. A preferred combination can be selected from the combinations for which there was some overlap within an area based on the luminance overlap, the specific points within the area, and the distribution of points within the area. For embodiments in which the designated chromaticity is specified, the combination providing a desired luminance range in the area containing the designated chromaticity is selected. In various embodiments, fewer than all possible combinations of pmats can be tested. Selected points distributed in the space of combinations can be tested, then other test combinations can be selected based on the results from the initially-tested combinations.

Selected primaries were calculated using a program as described above from measured data of a representative OLED emitter. Gamut 101 and aged gamut 111 both contained points within the 1 JND area. This example was calculated with three-bit intensities and approximately four-bit current densities. The luminance range of overlap for this example is approximately 470 nits to 10800 nits, and the center of the 1 JND area is approximately 7700K daylight (D77). The pmat for gamut 101 is (no scaling; luminances in nits):

| | | |
|---|---|---|
| 2632.821 | 7975.49 | 10603.02 |
| 2751 | 8205 | 10844 |
| 3501.838 | 11142.19 | 15064.76 |

The pmat for aged gamut 111 is:

| | | |
|---|---|---|
| 2.981029 | 186.6849 | 13885.32 |
| 3.28 | 195 | 14209 |
| 1.627379 | 195.7507 | 18815.55 |

These pmats can be used to calculate $I_p$ values as described above.

For example, to four significant figures, in gamut 101, intensities (0.2857, 0.1429, 0) produce approximately 1958 nits at (x,y)=(0.2936, 0.3040) (CCT=8154K), or (u',v')=(0.1938, 0.4514). In aged gamut 111, intensities (0, 0, 0.1429) produce approximately 2030 nits at (x,y)=(0.2960, 0.3029) (CCT=7989K), or (u',v')=(0.1959, 0.4511). These u'v' coordinates are 0.002121 Δu'v' apart, well within the 1 JND limit of 0.004478, indicating that they are indistinct in chromaticity.

The luminances can also be indistinct, depending on the white point of the display. For a white point of 2030 nits, the CIELAB ΔL* between these two points is 0.2990, indicating they are indistinct in luminance. The ΔE* between these two points is 0.5264, indicating that they are indistinct (1 JND≈1.0 ΔE*) in luminance and chromaticity. For a white point of 4000 nits, ΔL*=0.1626 and ΔE*=0.2984, also indistinct. Since these two points are indistinct in luminance and chromaticity, they are colorimetrically indistinct from each other, so they can be reproduced in gamut 101 and aged gamut 111 without objectionably-visible difference between them.

Therefore, the aging of EL emitter 50 is compensated with respect to these points: a non-aged panel using gamut 101 shows the point at 8154K, and the aged panel using aged gamut 111 shows the point at 7989K, but the user does not perceive an objectionable difference between these points. Put differently, these two points are within overlap gamut 121.

Figure 4:
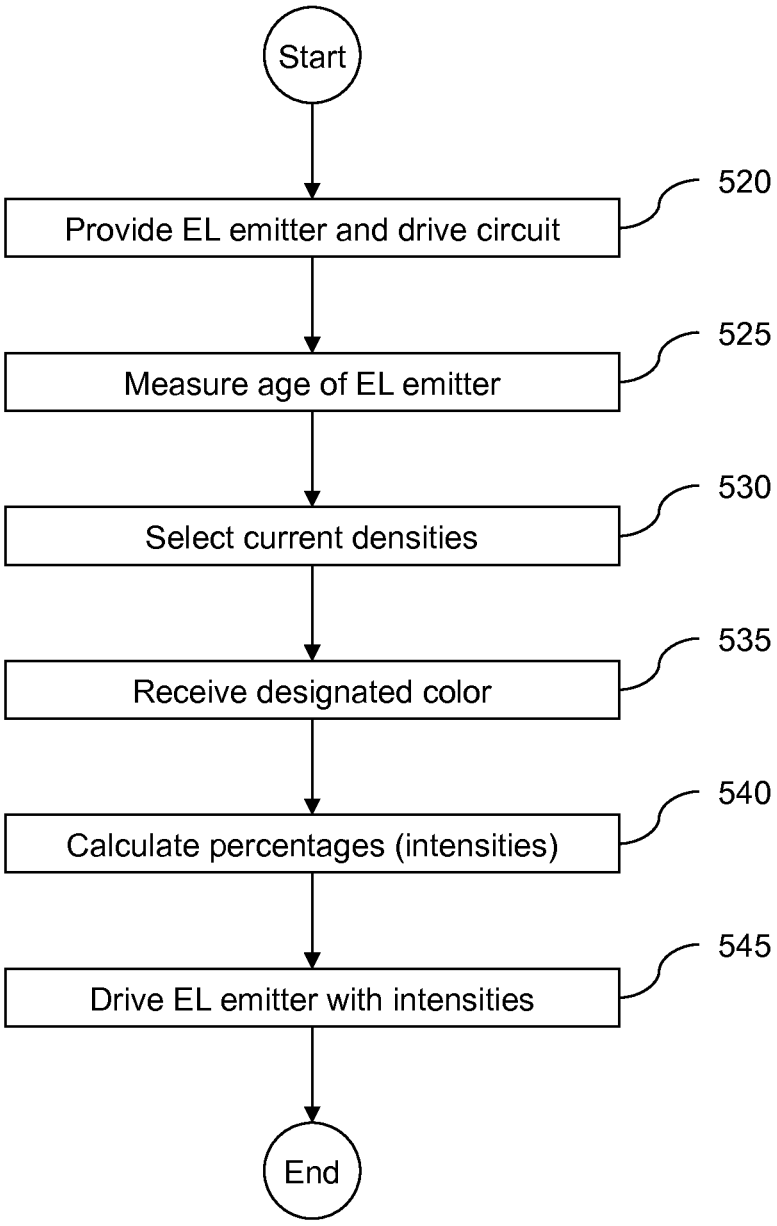
FIG. 4 is a flowchart of a method of compensating for aging of an EL emitter.

FIG. 4 is a flowchart of a method of compensating for aging of electroluminescent (EL) emitter 50. The EL emitter 50 and drive circuit 700 are provided (step 520). The age of EL emitter 50 is measured as described further below (step 525). The current densities are selected based on the measured age as described above (step 530). The designated color, i.e. the designated luminance and chromaticity, is received (step 535), e.g., from a processor or image-processing controller integrated circuit as known in the art. The percentages (intensities) of the primaries are calculated as described above (step 540). Finally, the EL emitter 50 is driven with the current densities at the respective intensities (step 545).

Structures for providing the EL emitter to receive current and emit light can be implemented on a variety of substrates with a variety of technologies. For example, EL displays can be implemented using amorphous silicon (a-Si) or low-temperature polysilicon (LTPS) on glass, plastic or steel-foil substrates. In one embodiment, an EL device according to the present invention is implemented using chiplets, which are control elements distributed over a substrate. A chiplet is a relatively small integrated circuit compared to the device substrate and includes a circuit including wires, connection pads, passive components such as resistors or capacitors, or active components such as transistors or diodes, formed on an independent substrate. Some details of chiplets and the processes used to make them can be found, for example, in U.S. Pat. No. 7,557,367; U.S. Pat. No. 7,622,367; US 2007/0032089; US 2009/0199960; and US 2010/0123268, the disclosures of all of which are incorporated by reference herein.

Figure 5:
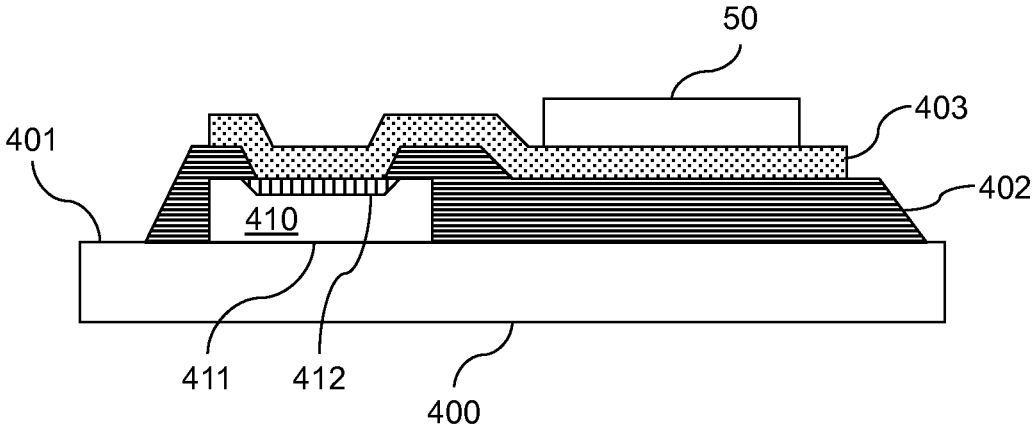
FIG. 5 is a side view of an EL device including a substrate and a chiplet according to various embodiments.

FIG. 5 shows a side view of an EL device using chiplets. Device substrate 400 can be glass, plastic, metal foil, or other substrate types known in the art. Device substrate 400 has a device side 401 over which the EL emitter 50 is disposed. An integrated circuit chiplet 410 having a chiplet substrate 411 different from and independent of the device substrate 400 is located over, and affixed to, the device side 401 of the device substrate 400. Chiplet 410 can be affixed to the device substrate using e.g., a spin-coated adhesive. Chiplet 410 includes a drive circuit 700 (FIG. 6) electrically connected to EL emitter 50 for providing the current to the EL emitter 50. Chiplet 410 also includes a connection pad 412, which can be metal. Planarization layer 402 overlays chiplet 410 but has an opening or via over pad 412. Metal layer 403 makes contact with pad 412 at the via and carries current from the drive circuit 700 within chiplet 410 to EL emitter 50. One chiplet 410 can provide current to one or to multiple EL emitters 50, and can include one drive circuit 700 or multiple drive circuits 700. Each drive circuit 700 can provide current to one or to multiple EL emitters 50.

Figure 6:
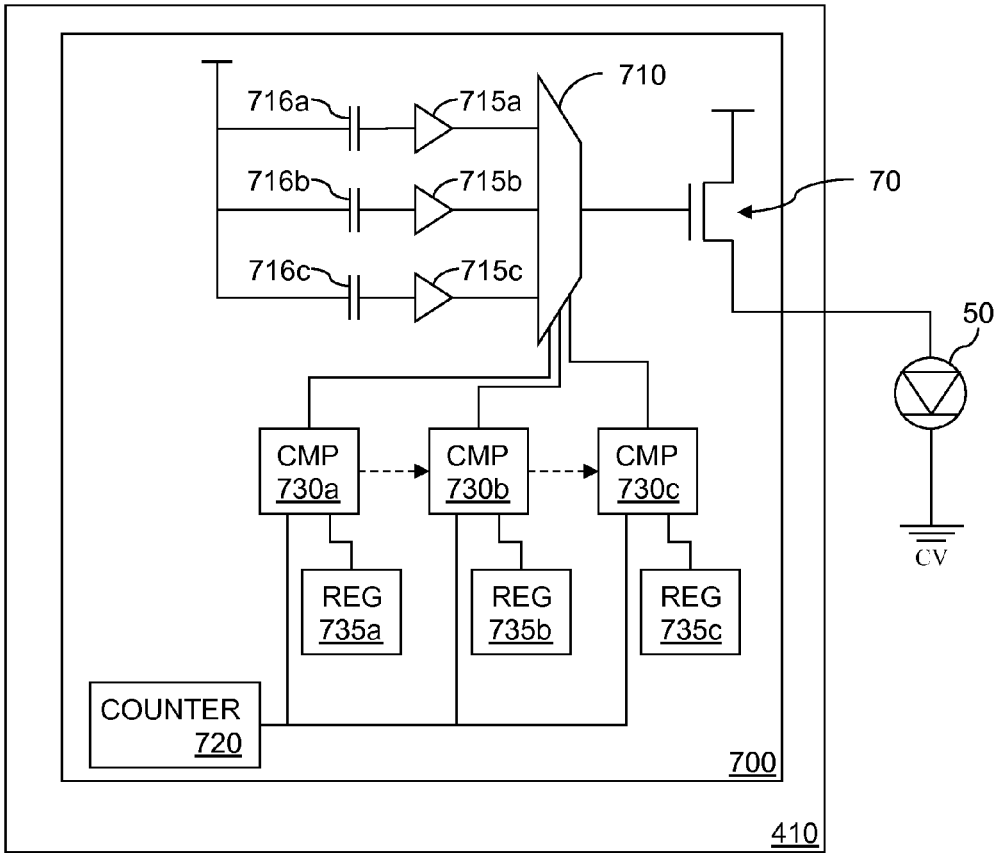
FIG. 6 is a schematic diagram of a drive circuit according to various embodiments.

FIG. 6 shows a drive circuit 700 in a chiplet 410 electrically connected to the EL emitter 50 for providing the current to the EL emitter 50. Drive circuit 700 includes drive transistor 70 for supplying the current to the EL emitter 50. The gate of drive transistor 70 is connected to multiplexer (mux) 710. Mux 710 has three inputs connected to the outputs of analog buffers 715*a*, 715*b*, and 715*c*. Each buffer's input is connected to a respective capacitor 716*a*, 716*b*, 716*c* for holding gate voltages of drive transistor 70 which correspond e.g., to the black 136, first 137 and second 138 current densities. The voltages can be stored on the capacitors by conventional sample-and-hold circuits (not shown). The selector inputs of mux 710 are connected to the outputs of comparators 730*a*, 730*b*, 730*c*. Each comparator compares the output from a running counter 720 to a trigger value or values stored in a respective register 735*a*, 735*b*, 735*c*. When the value of the counter is in the correct range for a particular current density, the corresponding comparator causes the mux to pass the corresponding gate voltage to drive transistor 70 to provide the corresponding current density to EL emitter 50.

Figure 8:
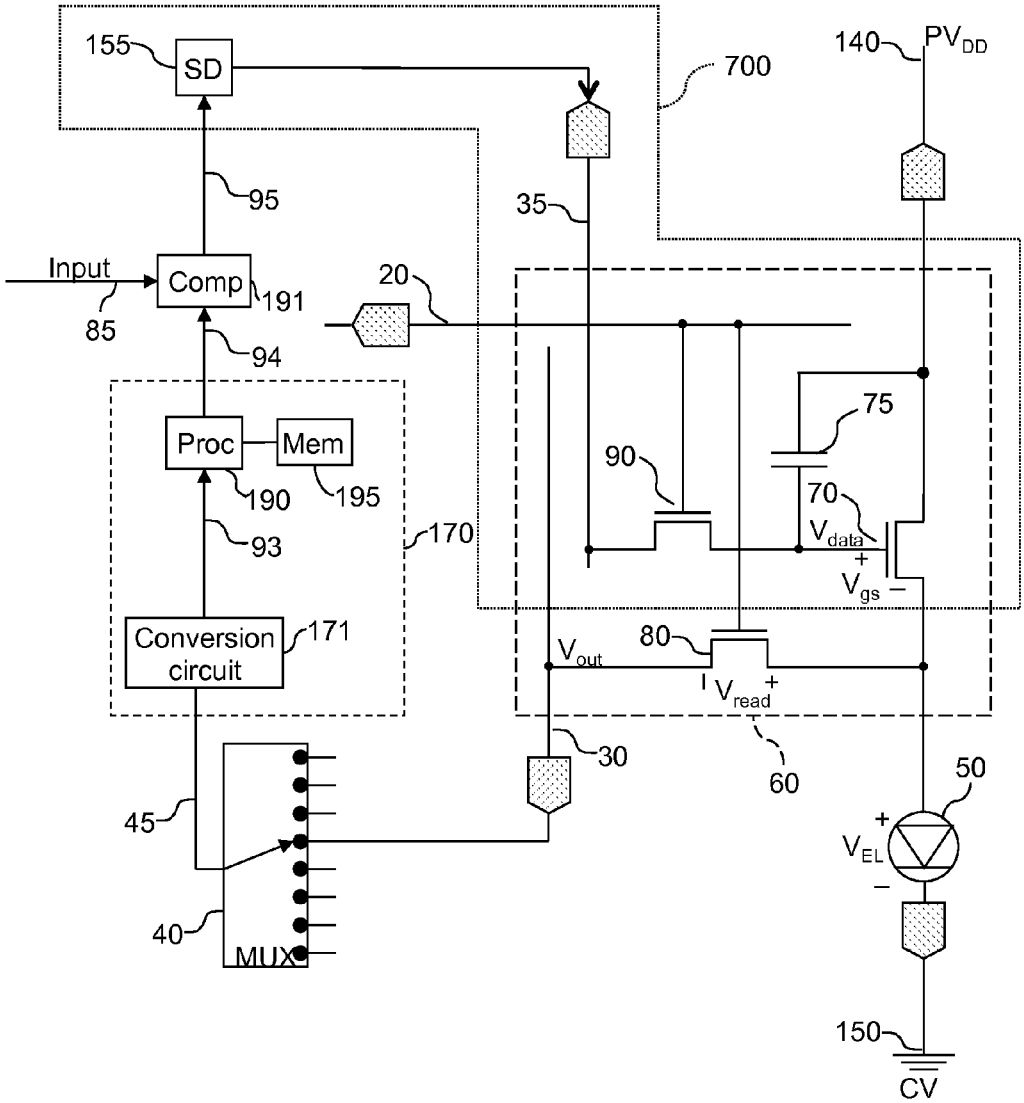
FIG. 8 is a schematic diagram of an EL subpixel and associated circuitry.
Figure 11:
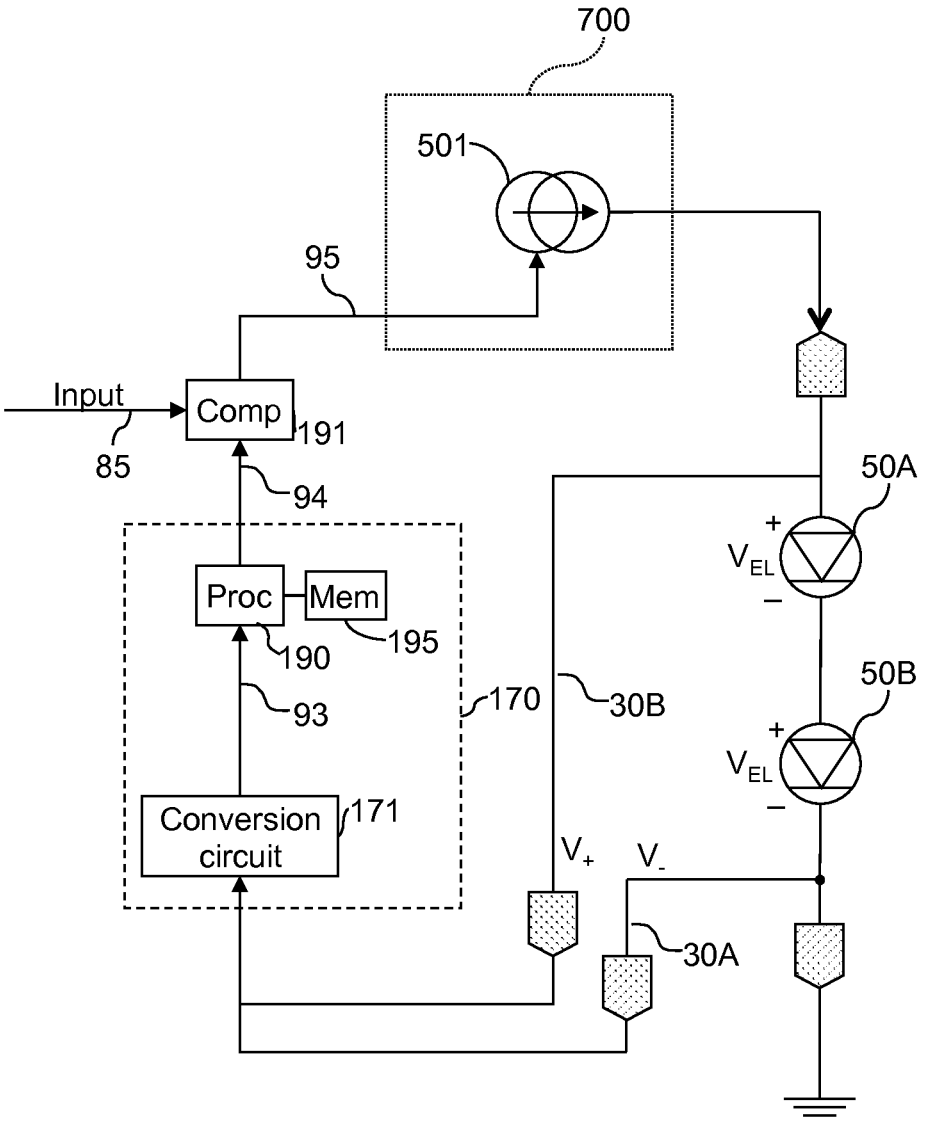
FIG. 11 is a schematic diagram of an EL lamp.

For example, an eight-bit counter can count 256ths of the emission period [0, $t_f$), starting at 0, crossing over to 255 at $t_f-t_f/256$, and rolling over back to 0 at $t_f$. When the counter value is 0 to the value stored in register 735*a* minus one, comparator 730*a* can output TRUE, and the other comparators output FALSE, to cause the mux 710 to pass the value from capacitor 716*a* to the gate of drive transistor 70. From the register 735*a* value to the register 735*b* value minus one, comparator 730*b* can output TRUE and the others FALSE, and from the register 735*b* value to the register 735*c* value, comparator 730*c* can output TRUE and the others FALSE. As indicated by the dashed arrows, comparators 730*a*, 730*b* and 730*c* can communicate with each other to indicate when the next comparator should output TRUE. This is one of many possible drive circuits which can be employed with the present invention; FIGS. 8 and 11 show two other drive circuits, and other configurations will be obvious to those skilled in the art. For example, multiple drive transistors can be used, and their outputs muxed to the EL emitter 50.

Referring back to FIG. 5, chiplets 410 are separately manufactured from the device substrate 400 and then applied to the device substrate 400. The chiplets 410 are preferably manufactured using silicon or silicon on insulator (SOI) wafers using known processes for fabricating semiconductor devices. Each chiplet 410 is then separated prior to attachment to the device substrate 400. The crystalline base of each chiplet 410 can therefore be considered a chiplet substrate 411 separate from the device substrate 400 and over which the chiplet circuitry is disposed. The plurality of chiplets 410 therefore has a corresponding plurality of chiplet substrates 411 separate from the device substrate 400 and each other. In particular, the independent chiplet substrates 411 are separate from the device substrate 400 on which the pixels are formed and the areas of the independent, chiplet substrates 411, taken together, are smaller than the device substrate 400. Chiplets 410 can have a crystalline substrate 411 to provide higher performance active components than are found in, for example, thin-film amorphous or polycrystalline silicon devices. Chiplets 410 can have a thickness preferably of 100 μm or less, and more preferably 20 μm or less. This facilitates formation of the planarization layer 402 over the chiplet 410 using conventional spin-coating techniques. According to one embodiment of the present invention, chiplets 410 formed on crystalline silicon substrates 411 are arranged in a geometric array and adhered to a device substrate 400 with adhesion or planarization materials. Connection pads 412 on the surface of the chiplets 410 are employed to connect each chiplet 410 to signal wires, power busses and row or column electrodes to drive pixels (e.g., metal layer 403). In some embodiments, chiplets 410 control at least four EL emitters 50.

Since the chiplets 410 are formed in a semiconductor substrate, the circuitry of the chiplet 410 can be formed using modern lithography tools. With such tools, feature sizes of 0.5 microns or less are readily available. For example, modern semiconductor fabrication lines can achieve line widths of 90 nm or 45 nm and can be employed in making the chiplets 410 of the present invention. The chiplet 410, however, also requires connection pads 412 for making electrical connection to the metal layer 403 provided over the chiplets 410 once assembled onto the device substrate 400. The connection pads 412 are sized based on the feature size of the lithography tools used on the device substrate 400 (for example Sum) and the alignment of the chiplets 410 to any patterned features on the metal layer 403 (for example ±5 μm). Therefore, the connection pads 412 can be, for example, 15 μm wide with 5 μm spaces between the pads 412. The pads 412 will thus generally be significantly larger than the transistor circuitry formed in the chiplet 410.

The pads 412 can generally be formed in a metallization layer on the chiplet 410 over the transistors. It is desirable to make the chiplet 410 with as small a surface area as possible to enable a low manufacturing cost.

By employing chiplets 410 with independent substrates 411 (e.g., comprising crystalline silicon) having circuitry with higher performance than circuits formed directly on the device substrate 400 (e.g., amorphous or polycrystalline silicon), an EL device with higher performance is provided. Since crystalline silicon has not only higher performance but also much smaller active elements (e.g., transistors), the circuitry size is much reduced. A useful chiplet 410 can also be formed using micro-electro-mechanical (MEMS) structures, for example as described in "A novel use of MEMs switches in driving AMOLED", by Yoon, Lee, Yang, and Jang, Digest of Technical Papers of the Society for Information Display, 2008, 3.4, p. 13.

The device substrate 400 can include glass and the metal layer or layers 403 can be made of evaporated or sputtered metal or metal alloys, e.g., aluminum or silver, formed over a planarization layer 402 (e.g., resin) patterned with photolithographic techniques known in the art. The chiplets 410 can be formed using conventional techniques well established in the integrated circuit industry.

Electroluminescent (EL) devices include EL displays and EL lamps. The present invention is applicable to both, and will be discussed first with reference to an EL display.

Figure 7:
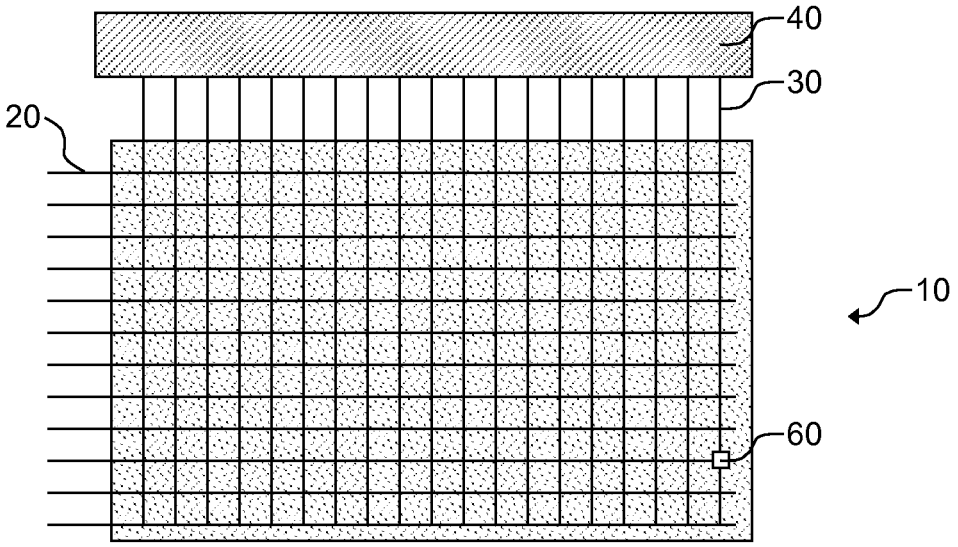
FIG. 7 is a schematic diagram of an EL display.

FIG. 7 shows a schematic diagram of an EL display. EL display 10 includes an array of a plurality of EL subpixels 60 arranged in rows and columns. EL display 10 includes a plurality of row select lines 20; each row of EL subpixels 60 has a corresponding select line 20. EL display 10 further includes a plurality of readout lines 30; each column of EL subpixels 60 has a corresponding readout line 30. Each column of EL subpixels 60 also has a data line (not shown) as is known in the art. The plurality of readout lines 30 is connected to one or more multiplexers 40, which permits parallel/sequential readout of signals from EL subpixels 60, as described below. Multiplexer 40 can be a part of the same structure as EL display 10, or can be a separate construction that can be connected to or disconnected from EL display 10.

FIG. 8 shows a schematic diagram of an EL subpixel and associated circuitry. The circuitry can be implemented in a chiplet, or using thin-film transistors (TFTs) on an LTPS or amorphous-silicon backplane. EL subpixel 60 includes EL emitter 50, drive transistor 70, capacitor 75, readout transistor 80, and select transistor 90. Drive transistor 70 is part of drive circuit 700 electrically connected to the EL emitter 50 for providing the current to the EL emitter 50. Each of the transistors has a first electrode, a second electrode, and a gate electrode. A first voltage source 140 is connected to the first electrode of drive transistor 70. By connected, it is meant that the elements are directly connected or connected via another component, e.g., a switch, a diode, or another transistor. The second electrode of drive transistor 70 is connected to a first electrode of EL emitter 50, and a second voltage source 150 is connected to a second electrode of EL emitter 50. Select transistor 90 connects data line 35 to the gate electrode of drive transistor 70 to selectively provide data from data line 35 to drive transistor 70 as well-known in the art. Each row select line 20 is connected to the gate electrodes of the select transistors 90 and of the readout transistors 80 in the corresponding row of EL subpixels 60.

The first electrode of readout transistor 80 is connected to the second electrode of drive transistor 70 and also to the first electrode of EL emitter 50. Each readout line 30 is connected to the second electrodes of the readout transistors 80 in the corresponding column of EL subpixels 60. Readout line 30 provides a readout voltage to measurement circuit 170, which measures the readout voltage to provide status signals representative of characteristics of EL subpixel 60.

A plurality of readout lines 30 can be connected to measurement circuit 170 through multiplexer-output line 45 and multiplexer 40 for sequentially reading out the voltages from the second electrodes of the respective readout transistors of a predetermined number of EL subpixels 60. If there is a plurality of multiplexers 40, each can have its own multiplexer-output line 45. Thus, a predetermined number of EL subpixels can be driven simultaneously. The plurality of multiplexers will permit parallel reading out of the voltages from the various multiplexers 40, and each multiplexer will permit sequential reading out of the readout lines 30 attached to it. This will be referred to herein as a parallel/sequential process.

Measurement circuit 170 for measuring the age of EL emitter 50 (FIG. 4 step 525) includes conversion circuit 171 and optionally processor 190 and memory 195. Conversion circuit 171 receives a readout voltage on multiplexer-output line 45 and outputs digital data on converted-data line 93. Conversion circuit 171 preferably presents high input impedance to multiplexer-output line 45. The readout voltage measured by conversion circuit 171 can be equal to the voltage on the second electrode of readout transistor 80, or can be a function of that voltage. For example, the readout voltage measurement can be the voltage on the second electrode of readout transistor 80, minus the drain-source voltage of the readout transistor and the voltage drop across the multiplexer 40. The digital data can be used as a status signal, or the status signal can be computed by processor 190 as will be described below. The status signal represents the characteristics of the drive transistor 70 and EL emitter 50 in the EL subpixel 60. Processor 190 receives digital data on converted-data line 93 and outputs the status signal on status line 94. Processor 190 can be a CPU, FPGA or ASIC, PLD, or PAL, and can optionally be connected to memory 195. Memory 195 can be nonvolatile storage such as Flash or EEPROM, or volatile storage such as SRAM.

A compensator 191 receives the status signal on status line 94 and a designated luminance and chromaticity on input line 85. Compensator 191 selects the current densities of the primaries using the status signal and calculates the percentages $I_p$ using the designated luminance and chromaticity and the selected current densities. It then provides information corresponding to the selected current densities and the calculated percentages on control line 95. Source driver 155 receives the information and produces a drive transistor control waveform on data line 35. The drive transistor control waveform includes the gate voltages necessary to cause the drive transistor to produce a current-density waveform such as those illustrated in FIGS. 3A and 3B. In one embodiment, the drive transistor control waveform includes a first gate voltage, a second gate voltage, and a black gate voltage in sequence for the percentages of the emission time corresponding to the black, first and second primaries. Thus, processor 190 can provide compensated data during the display process. As known in the art, the designated luminance and chromaticity can be provided by a timing controller (not shown). The designated luminance and chromaticity can correspond to an input code value. The input code value can be digital or analog, and can be linear or nonlinear with respect to commanded luminance. If analog, the input code value can be a voltage, a current, or a pulse-width modulated waveform.

Source driver 155 can include a digital-to-analog converter or programmable voltage source, a programmable current source, or a pulse-width modulated voltage ("digital drive") or current driver, or another type of source driver known in the art, provided that it can cause the drive transistor to produce a current-density waveform according to the present invention, e.g., FIGS. 3A and 3B. Drive circuit 700 includes source driver 155, select transistor 90, drive transistor 70 and the connections between those three parts and corresponding control lines.

Processor 190 and compensator 191 can be implemented on the same CPU or other hardware. Processor 190 and compensator 191 can together provide predetermined data values to data line 35 during the process of measuring the age of EL emitter 50.

Figure 9:
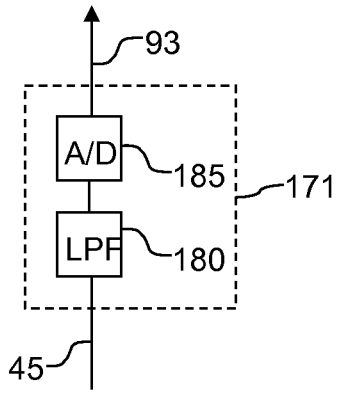
FIG. 9 is a schematic diagram of an analog-to-digital conversion circuit.

FIG. 9 shows conversion circuit 171, which includes analog-to-digital converter 185 for converting readout voltage measurements on multiplexer-output line 45 into digital signals. Those digital signals are provided to processor 190 on converted-data line 93. Conversion circuit 171 can also include a low-pass filter 180. In this embodiment, a predetermined test data value is provided to data line 35 by compensator 191 and the corresponding readout voltage on multiplexer-output line 45 is measured and used as the status signal.

While measurements are being taken, test data values can cause the emission of light from the EL emitter 50. This can be undesirably visible to a user of the EL display. Drive transistors 70, as known in the art, have a threshold voltage $V_{th}$ below which (or, for P-channel, above which) relatively little current flows, and so relatively little light is emitted. The selected reference voltage level can be less than the threshold voltage to prevent user-visible light from being emitted during measurement.

Figure 10:
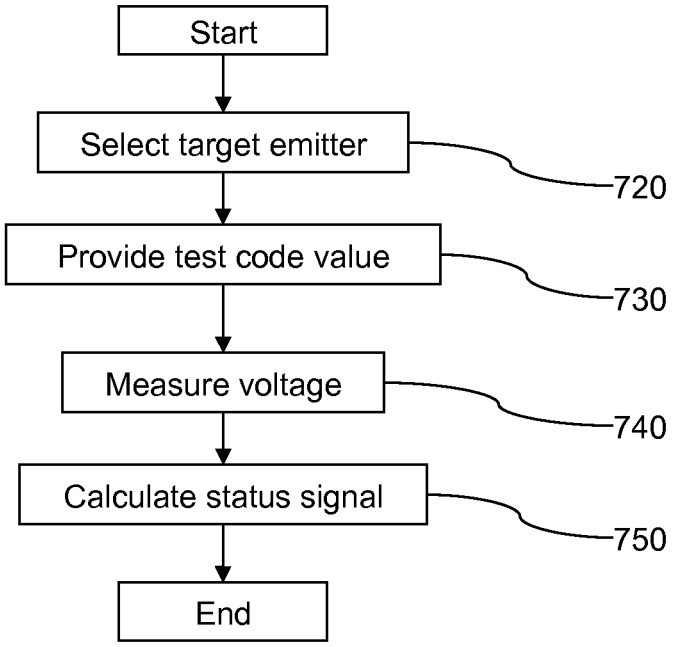
FIG. 10 is a flowchart of a method for measuring the age of an EL emitter.

Turning now to FIG. 10, and referring also to FIG. 8, there is shown a block diagram of a method for measuring the age of EL emitter 50. A target EL emitter 50 is selected (Step 1020) in a target EL subpixel 60. A test code values is provided to the target EL subpixel (Step 1030) to cause current to flow through EL emitter 50, and a measurement is taken of the voltage on the second electrode of the readout transistor 80 of the target subpixel (Step 1040). A status signal is then provided representing the characteristics of the drive transistor 70 and EL emitter 50 in the target subpixel 60 (Step 1050).

The test code value can be a selected voltage, or the voltage corresponding to a selected current density. The same test code value is preferably used for all measurements over the lifetime of the EL device.

The status signal represents the age of EL emitter 50, i.e. variations in the characteristics of the target EL emitter 50 in the target subpixel 60 caused by operation of the EL emitter 50 in that subpixel 60 over time. To calculate such a status signal, in either embodiment of conversion circuit 171 described above, a first readout voltage measurement can be taken of each subpixel and stored in memory 195 by processor 190. This measurement can be taken before the operating life of the EL device. During operation of the EL device, at a different, later time than the time at which the first readout voltage measurement was taken, a second readout voltage measurement can be taken of each subpixel and stored in memory 195. The first and second readout voltage measurements can then be used to compute a status signal representing variations in the characteristics of the drive transistor and EL emitter 50 caused by operation of the drive transistor and EL emitter 50 over time. For example, the status signal can then be calculated as the difference between the second readout voltage measurement and the first readout voltage measurement, or as a function of that difference, such as a linear transform.

Once the readout voltage has been measured for a subpixel, the corresponding status signal can be stored in memory 195. The compensator 191 can use that stored status signal to compensate any number of input code values. Measurements can be taken at regular intervals, each time the device is powered up or down, or at intervals determined by the usage of the device. Measurements can also be taken throughout the life of the device under normal operating conditions. Subpixels can be selected to be the target subpixel in any order. In one embodiment, they can be selected from top to bottom, according to the row scanning order of the device, and from left to right or right to left. In another embodiment, target subpixels can be selected at random positions in each row to reduce systematic bias due to factors such as temperature gradients.

Referring back to FIG. 8, voltage $V_{out}$ is measured. Voltage $V_{data}$ is known. Voltage $V_{read}$, the drop across the readout transistor, can be assumed to be constant as very little current flows through the readout transistor into the high input impedance of conversion circuit 171. Alternatively, $V_{read}$ can be characterized as a function of $V_{data}$ and $V_{out}$. Voltages PVDD and CV are selected. $V_{EL}$ can therefore be calculated as (Eq. 6):

$$V_{EL}=(V_{out}+V_{read})-CV \quad \text{(Eq. 6)}$$

Variations in the characteristics of the EL emitters 50 in the EL subpixels 60 are reflected in variations in the calculated $V_{EL}$. $V_{EL}$ can thus be used as a status signal. Before mass-production of the EL device (e.g., EL display 10), one or more representative devices can be characterized to produce an product model mapping the status signal, e.g., $V_{EL}$, for each subpixel to the corresponding selected black 136, first 137, second 138, and optionally third 139 current densities. More than one product model can be created. For example, different regions of the device can have different product models. The product model can be stored in a lookup table or used as an algorithm. Compensator 191 can store the product model(s), e.g., in memory 195.

In one embodiment for aging compensation according to the present invention, the difference $\Delta V_{EL}$ between $V_{EL}$ at the second readout voltage measurement and $V_{EL}$ at the first readout voltage measurement is used as the status signal. OLED aging is proportional to the integrated current passed through the devices over time, so a model can be made mapping $\Delta V_{EL}$ to the current densities of the primaries. This and other models can be combined by regression techniques known in the statistical art such as spline fitting.

An additional effect in aging compensation is OLED efficiency loss. It is known in the art that efficiency loss is correlated with $\Delta V_{EL}$. The luminance decrease and its relationship to $\Delta V_{EL}$ with a given current can be measured during manufacturing time and incorporated in the product model.

To compensate for the changes or variations in both chromaticity shift and efficiency loss characteristics of EL subpixel 60, the selected primaries and the designated luminance and chromaticity can be used together (Eq. 7):

$$I_p=pmat^{-1}\cdot[XYZ_d\cdot f_2(\Delta V_{EL})\cdot f_3(\Delta V_{EL},XYZ_d)] \quad \text{(Eq. 7)}$$

where $I_p$ is the column vector of intensities for the primaries calculated to maintain the desired luminance and chromaticity of EL emitter 50, pmat is a 3×3 pmat of the selected primaries as described above, $XYZ_d$ is the column vector of designated tristimulus values as described above, $f_2(\Delta V_{EL})$ is a correction for the change in EL resistance (e.g., OLED voltage rise), and $f_3(\Delta V_{EL}, XYZ_d)$ is a correction for the change in EL efficiency. Functions $f_2$ and $f_3$ are components of the product model, and can return scalars or matrices (where "·" denotes the appropriate type of multiplication, scalar or matrix, in Eq. 7). Using this equation, compensator 191 can control EL emitter 50 to achieve constant luminance output and increased lifetime at a given luminance. In another embodiment (Eq. 8), $f_2$ and $f_3$ return 3×3 matrices, and $$I_p=pmat^{-1}\times f_2(\Delta V_{EL})\times f_3(\Delta V_{EL},XYZ_d)\times XYZ_d \quad \text{(Eq. 8)}$$

If more than three primaries are used, pmat is extended to 3×4 or wider, and other transformations, such as white replacement, are used to calculate $I_p$. An example of such a technique useful with various embodiments is given in U.S. Pat. No. 6,885,380, issued Apr. 26, 2005 to Primerano et al., the disclosure of which is incorporated herein by reference.

FIG. 11 shows another technique for measuring the age of an EL emitter in an EL lamp. EL emitters 50A and 50B are arranged in series and are supplied current by current source 501. Drive circuit 700 includes current source 501 electrically connected to the EL emitters 50A, 50B for providing to each EL emitter current corresponding to a signal on control line 95. Readout line 30A carries $V_+$, the voltage of the anode of the first EL emitter 50A, to conversion circuit 171 in measurement circuit 170. Readout line 30B carries $V_-$, the voltage of the cathode of the second EL emitter 50B, to conversion circuit 171. The voltage across EL emitters 50A and 50B taken together is therefore $V_+-V_-$. Assuming the EL emitters 50A, 50B age identically, $V_{EL}=(V_+-V_-)/2$, and the compensation described above for $\Delta V_{EL}$ is performed, except that the compensated code value from compensator 191 represents a current rather than a voltage. This embodiment can also apply to a single EL emitter 50. The EL emitters 50A, 50B can also be driven by a constant voltage rather than a constant current, in which case the current through the EL emitters 50A, 50B, rather than the voltage $V_{EL}$, is measured. Processor 190, memory 195, converted-data line 93, status line 94, compensator 191, input line 85, and control line 95 are as described above on FIG. 8.

In some embodiments, the EL emitters arranged in series do not age identically. Additional readout lines (not shown), e.g., between EL emitter 50A and EL emitter 50B, can be used to measure each EL emitter's voltage independently.

In a preferred embodiment, the invention is employed in a device that includes Organic Light Emitting Diodes (OLEDs) which are composed of small molecule or polymeric OLEDs as disclosed in but not limited to U.S. Pat. No. 4,769,292, by Tang et al., and U.S. Pat. No. 5,061,569, by VanSlyke et al. Many combinations and variations of organic light emitting materials can be used to fabricate such a device. Referring to FIG. 8, when EL emitter 50 is an OLED emitter, EL subpixel 60 is an OLED subpixel. Inorganic EL devices can also be employed, for example quantum dots formed in a polycrystalline semiconductor matrix (for example, as taught in US 2007/0057263, the disclosure of which is incorporated herein by reference), and devices employing organic or inorganic charge-control layers, or hybrid organic/inorganic devices.

Transistors 70, 80 and 90 can be amorphous silicon (a-Si) transistors, low-temperature polysilicon (LTPS) transistors, zinc oxide transistors, or other transistor types known in the art. They can be N-channel, P-channel, or any combination. The OLED can be a non-inverted structure (as shown) or an inverted structure in which EL emitter 50 is connected between first voltage source 140 and drive transistor 70.

The invention has been described in detail with particular reference to certain preferred embodiments thereof, but it will be understood that combinations of embodiments, variations, and modifications can be effected within the spirit and scope of the invention.

PARTS LIST

10 EL display
20 select line
30, 30A, 30B readout line
35 data line
40 multiplexer
45 multiplexer-output line
50, 50A, 50B EL emitter
60 EL subpixel
70 drive transistor
75 capacitor
80 readout transistor
85 input line
90 select transistor
93 converted-data line
94 status line
95 control line
100 curve
101 gamut
102 black chromaticity
103 first chromaticity
104 second chromaticity
105 third chromaticity
108 line
110 aged curve
111 aged gamut
121 overlap gamut
125 point
129 threshold of visibility
130 curve
131 aged curve
132 black luminance
133 first luminance
134 second luminance
135 third luminance
136 black current density
137 first current density
138 second current density
139 third current density
140 first voltage source
150 second voltage source
155 source driver
170 measurement circuit
171 conversion circuit
180 low-pass filter
185 analog-to-digital converter
190 processor
191 compensator
195 memory
301, 302, 303, 304, 305, 306 time
308 emission time
310 waveform
320 waveform
330 waveform
400 device substrate
401 device side
402 planarization layer
403 metal layer
410 chiplet
411 chiplet substrate
412 pad
501 current source
520 step
525 step
530 step
535 step
540 step
545 step
700 drive circuit
710 multiplexer (mux)
715*a*, 715*b*, 715*c* buffer
716*a*, 716*b*, 716*c* capacitor
720 counter
730*a*, 730*b*, 730*c* comparator
735*a*, 735*b*, 735*c* register
1020, 1030, 1040, 1050 step

What is claimed is:

1. An electroluminescent (EL) device, comprising:

a) an EL emitter adapted to receive current and emit light having a luminance and a chromaticity that both correspond to the density of the current and an age of the EL emitter;

b) a drive circuit electrically connected to the EL emitter for providing the current to the EL emitter;

c) means for measuring the age of the EL emitter;

d) means for selecting different black, first and second current densities based on the measured age, wherein i) at the selected black, first and second current densities the emitted light has respective black, first and second luminances and respective black, first and second chromaticities;

ii) the respective luminance of each of the black, first and second current densities is colorimetrically distinct from the other two luminances, or the respective chromaticity of each of the black, first and second current densities is colorimetrically distinct from the other two chromaticities; and iii) the black luminance is less than a selected threshold of visibility, and the first and second luminances are greater than or equal to the selected threshold of visibility;

e) means to receive a designated luminance and a designated chromaticity for the EL emitter;

f) means for calculating respective black, first and second percentages of a selected emission time using the designated luminance, the designated chromaticity, and the black, first and second luminances and chromaticities, wherein the sum of the black, first and second percentages is less than or equal to 100%; and g) means for providing the black, first and second percentages to the drive circuit to cause it to provide the black, first and second current densities to the EL emitter for the black, first and second percentages, respectively, of the selected emission time, so that the integrated light output of the EL emitter during the selected emission time has an output luminance and output chromaticity colorimetrically indistinct from the designated luminance and designated chromaticity, respectively, whereby the aging of the EL emitter is compensated.

2. The EL device of claim 1, wherein the drive circuit provides only the black, first and second current densities.

3. The EL device of claim 1, wherein the EL emitter is a broadband emitter.

4. The EL device of claim 1, wherein the black current density is less than 0.02 $mA/cm^2$.

5. The EL device of claim 1, wherein the means for selecting includes a lookup table mapping the age to the selected black, first and second current densities.

6. The EL device of claim 1, wherein the sum of the black, first and second percentages equals 100%.

7. The EL device of claim 6, wherein the drive circuit is adapted to provide each of the black, first and second current densities for respective uninterrupted periods of time.

8. The EL device of claim 1, wherein the sum of the black, first and second percentages is less than 100%, and wherein the drive circuit is adapted to provide current ramps between consecutive current densities to the EL emitter.

9. The EL device of claim 8, wherein the current ramps are sinusoidal.

10. The EL device of claim 1, wherein the EL emitter is an organic light-emitting diode (OLED) emitter.

11. An electroluminescent (EL) device, comprising:

a) an EL emitter adapted to receive current and emit light having a luminance and a chromaticity that both correspond to the density of the current and an age of the EL emitter;

b) a drive circuit electrically connected to the EL emitter for providing the current to the EL emitter;

c) means for measuring the age of the EL emitter;

d) means for selecting different black, first, second and third current densities based on the measured age, wherein i) at the selected black, first, second and third current densities the emitted light has respective black, first, second and third luminances and respective black, first, second and third chromaticities;

ii) the respective luminance of each of the black, first, second and third current densities is colorimetrically distinct from the other three luminances, or the respective chromaticity of each of the black, first, second and third current densities is colorimetrically distinct from the other three chromaticities; and iii) the black luminance is less than a selected threshold of visibility, and the first, second and third luminances are greater than or equal to the selected threshold of visibility;

e) means for receiving a designated luminance and a designated chromaticity for the EL emitter;

f) means for calculating respective black, first, second and third percentages of a selected emission time using the designated luminance, the designated chromaticity, and the black, first, second and third luminances and chromaticities, wherein the sum of the black, first, second and third percentages is less than or equal to 100%; and g) providing the black, first, second and third percentages to the drive circuit to cause it to provide the black, first, second and third current densities to the EL emitter for the black, first, second and third percentages, respectively, of the selected emission time, so that the integrated light output of the EL emitter during the selected emission time has an output luminance and output chromaticity colorimetrically indistinct from the designated luminance and designated chromaticity, respectively, whereby the aging of the EL emitter is compensated.

12. The EL device of claim 11, wherein the sum of the black, first, second and third percentages equals 100%.

13. The EL device of claim 12, wherein the drive circuit provides each of the black, first, second and third current densities for respective uninterrupted periods of time.

14. The EL device of claim 12, wherein the drive circuit provides only the black, first, second and third current densities.

15. An electroluminescent (EL) device, comprising:

a) a device substrate having a device side;

b) an EL emitter adapted to receive current and emit light having a luminance and a chromaticity that both correspond to the density of the current and an age of the EL emitter, wherein the EL emitter is disposed over the device side of the device substrate;

c) an integrated circuit chiplet having a chiplet substrate different from and independent of the device substrate, wherein the chiplet includes a drive circuit electrically connected to the EL emitter for providing the current to the EL emitter and the chiplet is located over, and affixed to, the device side of the device substrate;

d) means for measuring the age of the EL emitter;

e) means for selecting different black, first and second current densities based on the measured age, wherein i) at the selected black, first and second current densities the emitted light has respective black, first and second luminances and respective black, first and second chromaticities;

ii) the respective luminance of each of the black, first and second current densities is colorimetrically distinct from the other two luminances, or the respective chromaticity of each of the black, first and second current densities is colorimetrically distinct from the other two chromaticities; and iii) the black luminance is less than a selected threshold of visibility, and the first and second luminances are greater than or equal to the selected threshold of visibility;

f) means to receive a designated luminance and a designated chromaticity for the EL emitter;

g) means for calculating respective black, first and second percentages of a selected emission time using the designated luminance, the designated chromaticity, and the black, first and second luminances and chromaticities, wherein the sum of the black, first and second percentages is less than or equal to 100%; and h) means for providing the black, first and second percentages to the drive circuit to cause it to provide the black, first and second current densities to the EL emitter for the black, first and second percentages, respectively, of the selected emission time, so that the integrated light output of the EL emitter during the selected emission time has an output luminance and output chromaticity colorimetrically indistinct from the designated luminance and designated chromaticity, respectively, whereby the aging of the EL emitter is compensated.

16. The EL device of claim 15, wherein the sum of the black, first and second percentages equals 100%.

17. The EL device of claim 16, wherein the drive circuit is adapted to provide each of the black, first and second current densities for respective uninterrupted periods of time.

18. The EL device of claim 17, wherein the sum of the black, first and second percentages is less than 100%, and wherein the drive circuit is adapted to provide current ramps between consecutive current densities to the EL emitter.

19. The EL device of claim 18, wherein the current ramps are sinusoidal.

20. The EL device of claim 15, wherein the EL emitter is an organic light-emitting diode (OLED) emitter.

* * * * *